US007202416B2

(12) United States Patent
Komuro et al.

(10) Patent No.: US 7,202,416 B2
(45) Date of Patent: Apr. 10, 2007

(54) ELECTROMAGNETIC INSULATION WIRE, AND METHOD AND APPARATUS FOR MANUFACTURING THE SAME

(75) Inventors: Matahiro Komuro, Hitachi (JP); Naofumi Chiwata, Hitachi (JP); Masato Miyataki, Hitachi (JP); Takanori Yamazaki, Mito (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 10/886,587

(22) Filed: Jul. 9, 2004

(65) Prior Publication Data

US 2005/0006131 A1 Jan. 13, 2005

(30) Foreign Application Priority Data

Jul. 10, 2003 (JP) ..... 2003-194711

(51) Int. Cl.
*H01B 7/00* (2006.01)

(52) U.S. Cl. ..... 174/102 SC; 174/110 R

(58) Field of Classification Search ..... 174/36, 174/102 SC, 110 R
See application file for complete search history.

(56) References Cited

U.S. PATENT DOCUMENTS 1,672,979 A * 6/1928 Fondiller ..... 178/45
3,229,030 A * 1/1966 Baermann ..... 174/117 F
6,048,601 A * 4/2000 Yahagi et al. ..... 428/147

FOREIGN PATENT DOCUMENTS

| | | | |
|---|---|---|---|
| JP | 11-040979 | | 2/1999 |
| JP | 11-040981 | | 2/1999 |
| JP | 2000-192104 | * | 7/2000 |
| JP | 2000-251545 | | 9/2000 |

* cited by examiner

*Primary Examiner*—Chau N. Nguyen
(74) *Attorney, Agent, or Firm*—Antonelli, Terry, Stout & Kraus, LLP.

(57) ABSTRACT

The present invention is concerned with an electromagnetic insulation wire, a method of manufacturing the same and an apparatus for manufacturing the same. The wire comprises a conductor and an electromagnetic insulation coat containing magnetic powder dispersed in a resin matrix. The particles of the powder are oriented in the coat in the circumferential direction of the conductor. The particles are oriented in the magnetic field, while the conductor and the composite material are passed through a die heated to a certain temperature.

8 Claims, 5 Drawing Sheets

ELECTROMAGNETIC INSULATION WIRE, AND METHOD AND APPARATUS FOR MANUFACTURING THE SAME

CLAIM OF PRIORITY

The present application claims priority from Japanese application serial No. 2003-194711, filed on Jul. 10, 2003, the content of which is hereby incorporated by reference into this application.

DESCRIPTION OF THE INVENTION

Field of the Invention

The present invention relates to a new electromagnetic insulation wires or cables for counter-measures of EMC (Electromagnetic compatibility), a method of manufacturing the electromagnetic insulation wire and an apparatus for manufacturing the same.

Japanese Patent Laid-open 2000-251545 discloses electric wires for EMC counter-measures, wherein Japanese Patent laid-open Hei 11-40979 and Hei 11-40981 disclose a soft magnetic material powder is bonded with an organic binder to form a tape or cylinder.

In the EMC counter-measure technology disclosed in Japanese Laid-open 2000-251545, a tape or foil of the soft magnetic material is wound to form a magnetic tube, which is then covered with a flexible coat. The flexibility of the wire depends on the distance between the magnetic tubes. Thus, it is hard to obtain wires with high flexibility, and the productivity of the winding process is quite low. Further, steps between the windings are formed by magnetic tubes on the surface of the wire so that the handling of the wire is not good.

In technologies disclosed in Japanese Patent Laid-open Hei 11-40979 and Hei 11-40981, the counter-measure parts are not directly formed on the conductors, which are not easy to handle. Further, it is difficult to increase a wiring density in the above prior art.

SUMMARY OF THE INVENTION

It is an object of the present invention to provide an electromagnetic insulation wire, which can effectively reduce electromagnetic noise induced in the conductor and have a high flexibility, a method of manufacturing the same, and an apparatus for manufacturing the same.

The present invention provides an electromagnetic insulation wire, which has an electromagnetic insulation coat of a composite material comprising a magnetic powder and a matrix resin, wherein the particles of the magnetic powder are oriented in such a manner that a magnetic anisotropy in terms of magnetic permeability in the circumferential direction of a conductor is larger than that in the lengthwise direction of the conductor. The present invention also provides a method of manufacturing the electromagnetic insulation wire and an apparatus for manufacturing the electromagnetic insulation wire.

In the specification, the terms "electromagnetic insulation wire" are used to mean a wire or cable having a electromagnetic insulation coat having magnetic anisotropy in the circumferential direction and in the axial direction of the wire.

In this specification, the explanation will be made by reference to wires as a representative. Although the wire of the present invention is defined as insulated wires for lowering electro-magnetic radiation wave, the "electromagnetic insulation wire" is used for simplification of the specification and claims. That is, the word "wire" is used to cover the cable. The wire or cable is used to mean that signals are transferred through the conductor.

The coat of the present invention is substantially free from irregularity of magnetic property both in the lengthwise and circumferential directions of the wire, since the coat is continuously formed on the conductor under substantially constant magnetic conditions.

DETAILED DESCRIPTION OF THE PREFERRED EMBODIMENTS

An aspect ratio of at least part of the particles of the magnetic powder is more than 1, and the particles in the lengthwise direction thereof are arranged in the circumferential direction of the conductor Preferably, the aspect ratio is within a range of from 2 to 10.

Figure 3:
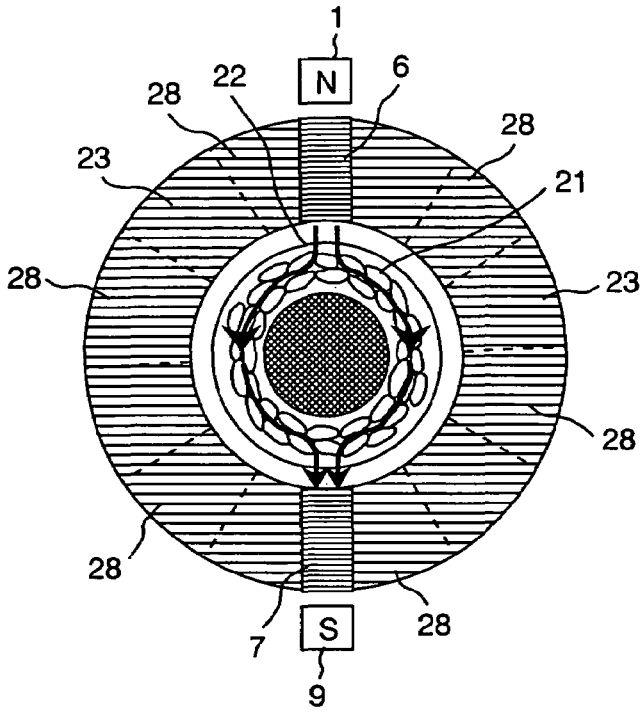
FIG. 3 is a front plan view of the apparatus shown in FIG. 2.

The particles of the magnetic powder in the produced coat of the wire are arranged in the circumferential direction as shown in FIG. 3. The coat has basically a substantially homogeneous orientation of the particles in the axial direction of the wire in view of the manufacturing process. That is, there is no unevenness or magnetic gaps of the magnetic property of the coat in the axial direction. Further, there is no overlapping of the coat, which may lead to lowering of permeability of the coat in the circumferential direction.

According to the present invention, it is possible to manufacture a wire of indefinite length or very long wire with a constant magnetic property over the entire length.

The present invention also provides a method of manufacturing an electromagnetic insulation wire, which comprises forming the coat of a composite material comprising magnetic powder of soft magnetic material and a binder resin on a conductor, while applying a magnetic field to the conductor and the composite material. At least part of the particles of the magnetic powder is arranged along the direction of the magnetic lines of force of the magnetic field. The composite material comprising the magnetic powder and the resin and the conductor are continuously supplied to the entrance of a die which is heated. A magnetic field generation means, which is disposed near the exit of the die applies the magnetic field to the composite material and the conductor, while forming the coat on the conductor.

The present invention further provides an apparatus for manufacturing an electromagnetic insulation wire, which comprises a heated die for withdrawing or extruding a conductor with an insulating coat and a magnetic field generation means disposed near the exit of the die.

At least an exit side of the die is preferably made of a non-magnetic material, such as tungsten, ceramics. Means for applying the magnetic field is a permanent magnet or an electromagnet. Preferable permanent magnet material is Sm—Co sintered alloys. The permanent magnets should have a Curie point as high as 100° C. or more.

A yoke made of a soft magnetic material is preferably disposed around the periphery of the exit of the die. The yoke is in contact with the permanent magnet or electromagnet to constitute a magnetic circuit.

In order to apply the magnetic field to the extruded or withdrawn wire during manufacturing it, the die may be sandwiched by a pair of the permanent magnets or electromagnets. The yokes are so disposed as to sandwich the wire thereby to make a magnetic circuit through a magnetic gap. The permanent magnets, electromagnets or yokes have different lengths in the radial direction of the conductor so that the lengthwise direction of the particles of the magnetic powder is arranged in the circumferential direction of the conductor.

It is preferable to dispose a heater or heaters around the periphery of the die and to form an introduction port such that the insulating material is supplied to the whole circumference of the conductor.

As magnetic powders, soft magnetic materials are used. Examples are $\gamma$-$Fe_2O_3$, $Fe_3O_4$, Fe, Co, Ni, Fe—Co, Fe—Co—Ni, Fe—Si—Al, etc. The powders are used singly or in combination.

As resin materials, thermoplastic resins are preferably used. Examples are polyolefin, polyvinyl chloride, chlorinated polyethylene, chlorinated butyl rubber, thermoplastic elastomer, other ethylene copolymers such as ethylene-ethyl acetate copolymer, ethylene-ethylacrylate copolymer and ethylene propylene rubber, etc. The resin materials are used singly or in combination.

One or more of the resin materials is mixed with the magnetic powder before introducing them into the die. In forming the insulating coat on the surface of the conductor, the mixture or composite material is heated to melt or soften it so that the particles of the powder can easily move to be oriented along the magnetic field applied in the magnetic field of a predetermined strength. As a result, easy magnetization axis or anisotropic rectangularity of the particles of the magnetic powder is aligned along the magnetic lines of force on the magnetic field.

The strength of the magnetic field for orienting the particles of the magnetic powder is determined by kinds of magnetic materials used, viscosity of the resin when heated by the heater, volume rate of the magnetic powder in the composite material, coating speeds, etc. The magnetic powder is prepared by an atomizing method, followed by rolling the powder to flatten it, or by dropping molten metal on a surface of a rotating roll to make foil, followed by cutting the foil into pieces. Thus, particles of the powder have an aspect ratio more than one. The word "powder" in this specification includes not only typical powder, but various small pieces irrespective of their shapes, rods, flakes, tapes, ribbons, etc.

Powder, chips, or the like of the resins are acceptable. In case of chips, the resin is mixed with the magnetic powder by a loader.

The composite material comprising the magnetic powder and the resin is filled in the cavity of the die for extrusion or drawing under heating. Since a pressure is imparted to the composite material wherein the resin is melted by heating, it is not sufficient to impart magnetic anisotropy to the particles in the composite material by magnetic field. However, at the exit side of the die where the thickness of the coat on the conductor is small, magnetic anisotropy in the direction of the applied magnetic field is relatively easily imparted to the particles of the magnetic powder by concentrating magnetic lines of force in the vicinity of the exit. In general, a thickness of about 0.1 to 1 mm is preferable for the coat, while it may change in accordance with the concentration of the magnetic powder, kinds of magnetic powder, etc. A preferable concentration of the magnetic powder is 10 to 50% by volume of the composite material (magnetic powder+resin matrix).

The magnetic field should have a vector in the circumferential direction of the conductor. The field can be generated by forming a magnetic field by disposing a permanent magnet in the soft magnetic material.

The former magnetic circuit controls the magnetic field by flowing current through the coil. In the former case, a power source for exciting the coil is necessary. On the other hand, in the latter case, since the rare earth magnets having a large elegy product are used as a source of the magnetic field, no power source for excitation of the coil is necessary.

Since the die is heated to a temperature above 100° C., permanent magnets having a high Curie point and a small temperature coefficient of energy product such as NdFeB alloys, Sm—Co alloys are preferable. The magnetic circuits are so formed that a magnetic gap is formed near the exit of the die so as to minimize the cross sectional area of the magnetic material near the exit of the die. As a result, the magnetic field can be concentrated in a small sectional area, thereby generating strong magnetic field.

The resin material in the composite material is melted by the heater disposed around the outer periphery of the die. In forming the coat on the conductor, the magnetic field of strength more than 1 kOe is generated around the conductor to impart magnetic anisotropy to the magnetic powder.

As having discussed above, the present invention provides the electromagnetic insulation wire having the magnetic coat with no steps on the wire. The coat comprises the soft magnetic material and the resin material. In forming the composite material around the conductor, the outside magnetic field is imparted to the wire to form an anisotropic material.

When the permeability in the circumferential direction of the composite material is increased, noise of the conductor is effectively reduced even by a small amount of magnetic powder than an isotropic composite material. The wire is excellent in flexibility; the wire can be used as cables, signal wires, etc of personal computers, electronic appliances, etc, which have good EMC countermeasure effect.

Embodiment 1

Figure 1:
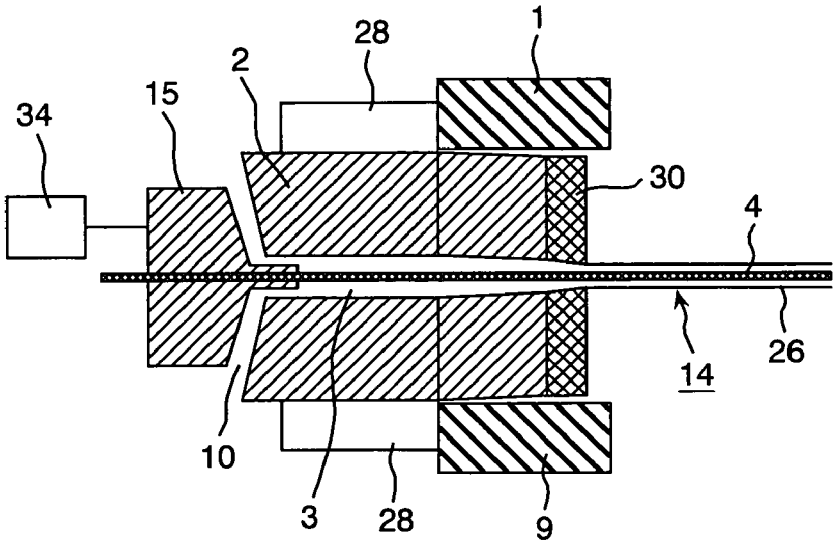
FIG. 1 is a cross sectional view of an apparatus for manufacturing an electromagnetic insulation wire of one embodiment of the present invention.

FIG. 1 shows a cross sectional view of an apparatus for manufacturing an electromagnetic insulation wire according to the present invention. In FIG. 1, a die 2 has an exit side a part of which is made of a ferromagnetic material 30 to constitute a magnetic circuit with permanent magnets 1, 9 for applying magnetic field to the wire 14 comprising the conductor 4 and a coat 26. The coat comprises magnetic powder and resin material.

Figure 10:
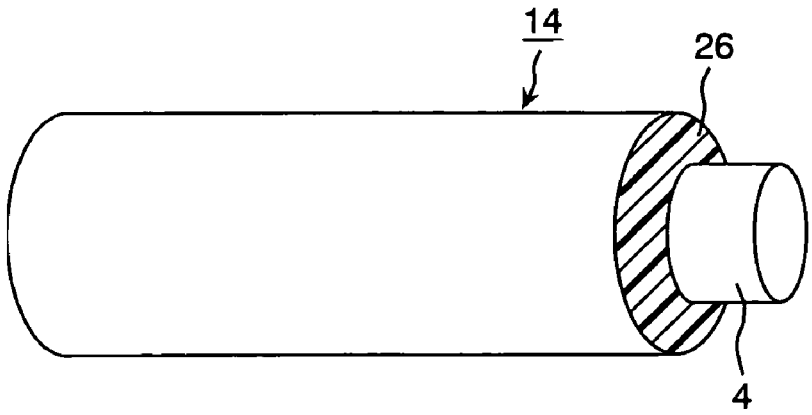
FIG. 10 is a view of an electromagnetic insulation wire in accordance with the present invention.

The permanent magnets 1, 9 are made of a sintered NdFeB alloy or sintered SmCo alloy to sandwich the exit side of the die 2. Heater 28 is so disposed around the cavity 3 to heat the composite material in the cavity 150 to 200° C., thereby to melt the resin material therein. The conductor 4 is introduced into the cavity 3 from a reel (not shown) through an aperture of a pressure member 15, and the composite material is introduced from the introduction port 10 so that the composite material in the cavity 3 is pressurized with a high pressure. The wire 14 is extruded by means of an extruding machine 34 into the cavity to the exit of the die 2, while forming the coat 26 on the conduct 4, as shown in FIG. 10. for example.

The permanent magnets 1, 9 may be substituted with an electromagnet to constitute the magnetic circuit. In this case, it is possible to control the magnetic strength of the magnetic field around the exit side of the die 2. An increase in current in the electromagnet increases the strength of the magnetic field around the exit side of the die 2, thereby to increase a circumferential vector of the magnetic field around the conductor 4. The increase in the circumferential vector strengthens the anisotropy of the coat 26. Whether the anisotropy is imparted to the coat 26 is confirmed by determining the magnetic characteristics of the coat 26 on the conductor 4.

In this embodiment, a composite material comprising 30 volume % of magnetic powder of a magnetic alloy consisting of Fe-11% by weight of Si-3 to 8% by weight of Al and 70 volume % of chlorinated polyethylene was introduced into the cavity 3 heated by the heater 28. The particles of the magnetic powder have an aspect ratio of 2 to 10. In the cavity 3, and the introduction port has an annular form in its cross sectional view. The conductor 4 is extruded into or withdrawn from the die 2, while continuously forming the coat 26 thereon. After the insulating coat wire 14 is formed, it is cooled. In the apparatus shown in FIG. 1, the die 2 has the entrance side for introducing the conductor 4 and the composite material and the exit side 30 made of a non-magnetic material such as W alloy. The electromagnet or permanent magnet 1 is disposed at the exit side extending beyond the end of the exit as shown in FIG. 1. According to this structure, N—S poles are formed in the coat 26 so that the lengthwise direction of the particles of the magnetic powder is oriented in the circumferential direction of the conductor. The cavity 3 has a tapered shape towards the exit direction so that the diameter of the exit side is the smallest.

The composite material 26 coated on the conductor 4 is cooled until the magnetic particles are fixed in the coat. Cooling is carried out by a suitable cooling device (not shown) or by a natural cooling.

The magnetic characteristics such as orientation dependency on magnetization curve of the resulted coat 26 are measured by a torque meter or a Karr-effect meter. The evaluation of the magnetic anisotropy of the coat is made by comparison between magnetic characteristics in the circumferential direction and the axial direction (lengthwise direction of the wire). Further, a disk sample is prepared from the wire to measure torque curve, thereby to evaluate magnetic anisotropy energy.

In this embodiment, it has been confirmed by alternating magnetic measurement that the coat 26 has a higher permeability in the circumferential direction than in the axial direction of the wire as an increase in the strength of the magnetic field.

Further, in this embodiment, the particles of the magnetic powder are oriented in the circumferential direction of the conductor 4. Therefore, the flexibility of the wire is excellent in the lengthwise direction of the wire as a whole.

Embodiment 2

Figure 2:
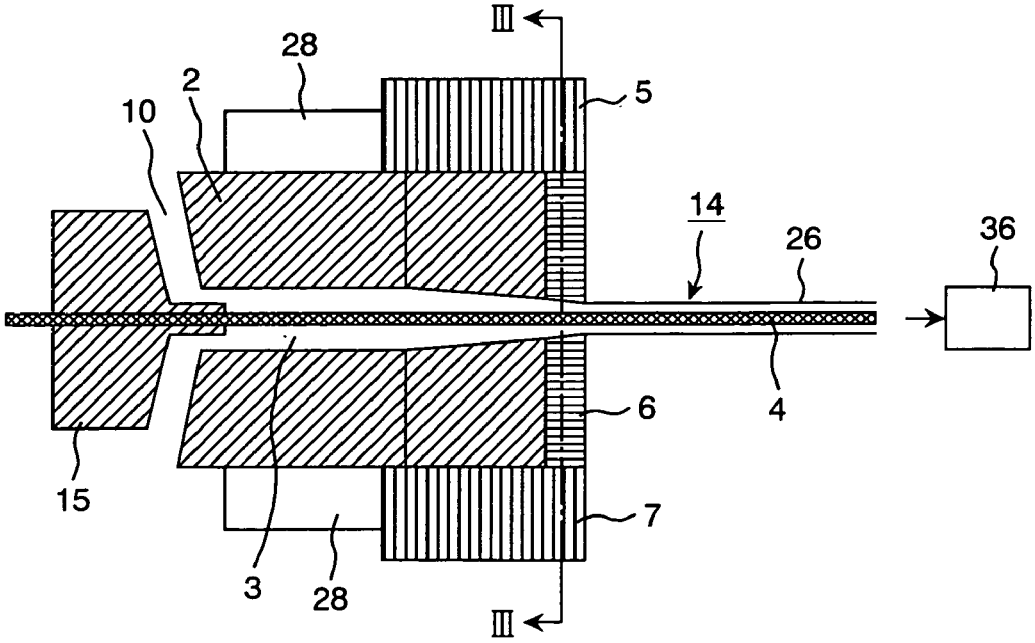
FIG. 2 is a cross sectional view of an apparatus of another embodiment of the present invention.

FIG. 2 shows a cross sectional view of another embodiment of the apparatus according to the present invention, and FIG. 3 is a front cross sectional view along the line III—III of FIG. 2. In FIG. 2, yokes 6 made of soft magnetic material are disposed at the exit side of the die 2, thereby to concentrate magnetic field on the conductor 4. Further, as shown in FIG. 3, permanent magnets or electromagnets 5, 7 are disposed to sandwich the wire 14. Therefore, magnetic circuits are formed among the permanent magnets or electromagnets—yokes—wire.

The upper magnet and the upper yoke are connected by means of magnetic lines 22 of force, and the lower magnet and lower yoke are connected by means of magnetic lines 22 of force. As a result, the particles 21 of the magnetic powder are oriented in the circumferential direction of the conductor 4. The exit side 23 of the die 2 is made of non-magnetic material except for the yokes.

The coat 26 is formed on the surface of the conductor 4. Since the specific permeability of the coat 26 is higher than that of the non-magnetic member 23, the magnetic lines of force transmit the coat. As a result, the magnetic field is applied in the circumferential direction of the coat, thereby to impart magnetic anisotropy to the magnetic powder particles and the lengthwise direction of the particles is oriented in the circumferential direction.

In this embodiment, particles of soft magnetic material such as Fe—Si magnetic powder had an aspect ratio of 3 or more. A composite material comprising the powder and chlorinated polyethylene and the powder was mixed and the mixture was introduced into the cavity 3 of the heated die 2 through an introduction port 10. The conductor 4 was extruded into or withdrawn from the die 2 to continuously form the coat 26 thereon. The wire 14 is withdrawn by means of a machine 36 from the exit side of the die 2.

Figure 4:
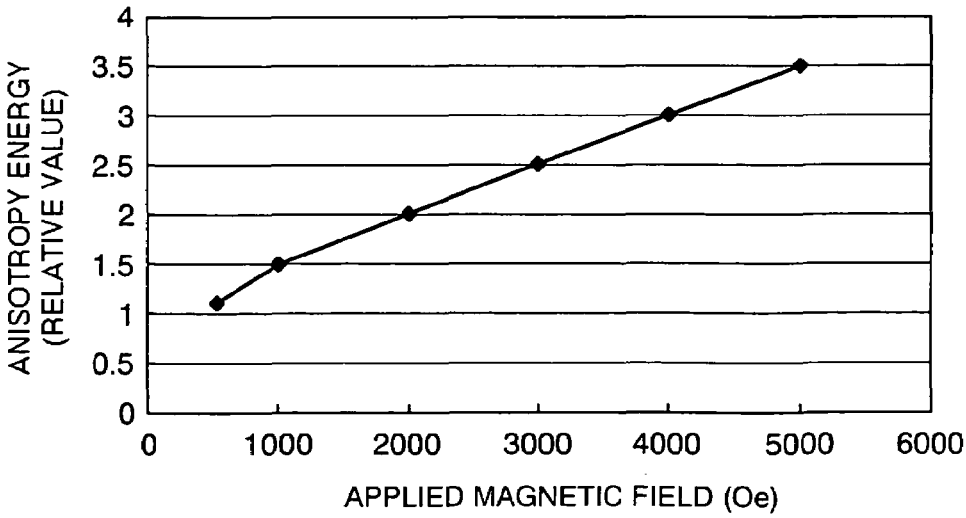
FIG. 4 is a graph showing relationship between an anisotropic energy of an electromagnetic insulation coat formed around a conductor and strength of an applied magnetic field.

FIG. 4 shows a graph showing relationship between magnetic strength of the magnetic field and anisotropic energy. As shown in FIG. 4, the anisotropic energy of the coat containing Fe—Si powder (aspect ratio of particles: 3, volume rate of the powder: 30%) on the conductor increases as the magnetic strength increases. When the magnetic field of 500 Oe or more is applied, a considerable increase in anisotropic energy of the coat was observed. The anisotropic energy can be determined by measuring torque curve or magnetization.

The anisotropy is increased by alignment of easy magnetization axis of the particles of the magnetic powder in the magnetic field. If the magnetic field is applied between the upper and lower yokes at the ends of the die 2, the particles of the magnetic powder rotate along the magnetic lines of force 22 so that the particles are oriented in a definite direction.

The rotation of the particles of the magnetic powder depends on viscosity of the melted resin in the cavity, temperature of the die, magnetic strength of the magnetic field, a particle size of the powder, etc. The direction of the magnetic field depends on a contour of the yokes, a thickness of the coat.

Further, since the lengthwise direction of the particles is aligned with the circumferential direction of the conductor 4, the resulting wire has excellent flexibility as a whole.

Embodiment 3

In this embodiment, particles of magnetic powder of Fe—B powder having an aspect ratio of 3 were used. The powder was mixed with low-density polyethylene. The mixture was introduced into the cavity through the introduction port of the apparatus shown in FIG. 2. In the same manner as in Embodiment 1, the coat was formed on the conductor 4, while extruding or withdrawing the conductor from the die 2.

In this embodiment, a permanent magnet of sintered $Sm_2Co_{17}$ alloy was used as the magnet 1, 9 shown in FIG. 2. In order to concentrate magnetic lines of force near the exit side of the die 2, a pair of yokes is disposed at the end of the cavity in the die, as shown in FIG. 2. The yokes sandwich the cavity. The yokes are made of Fe or FeCo alloy. A magnetic circuit can be formed by disposing a member of ferromagnetic material at the front side of the die. The permanent magnet can be disposed at only one side of the die to form the magnetic field.

Figure 5:
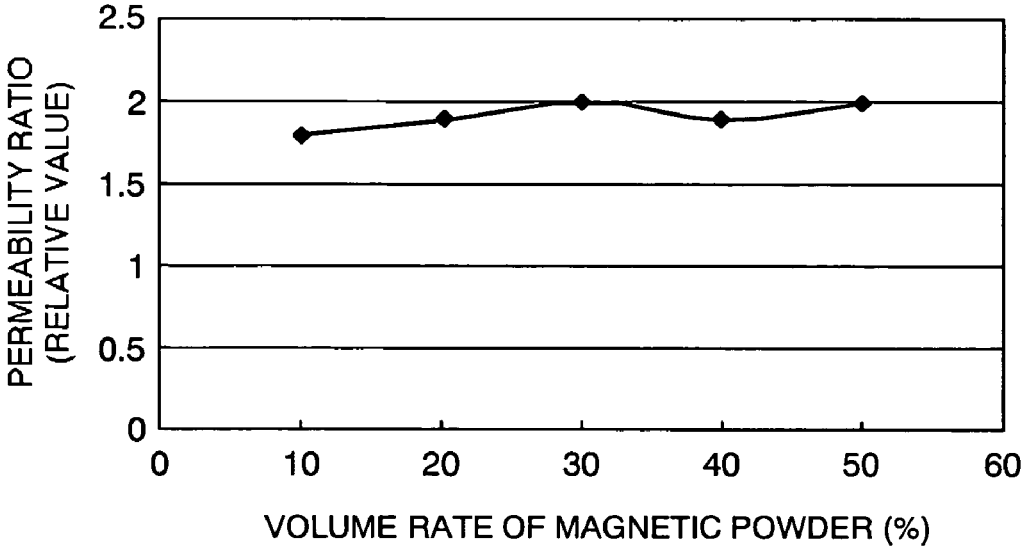
FIG. 5 is a graph showing relationship between permeability ratio (relative value) of the electromagnetic insulation coat measured in a magnetic field of 3000 Oe and a volume rate of the magnetic powder in the insulating coat.

FIG. 5 is a graph showing relationship between permeability ratio and a volume rate of the magnetic powder in the composite material. The permeability ratio is defined as a ratio of permeability in the circumferential direction of the conductor to that of the axial direction of the conductor. As shown in FIG. 5, when the magnetic strength of the magnetic field is 300 Oe, the permeability ratio in case of the volume rate of the magnetic powder over 10 to 50% is nearly constant as shown in FIG. 5. On the other hand, under no magnetic field, there is almost no difference in permeability between the directions. In case of a volume rate of magnetic powder of 10% in the magnetic field, a dependency of the permeability ratio on direction appears, and the absolute values are 1.8 to 2.0.

As having discussed above, the dependency of permeability ratio on direction is caused by imparting anisotropy of easy magnetization to the particles of the magnetic powder in the anisotropic magnetic field. Further, in this embodiment, the lengthwise direction of the particles is oriented in the circumferential direction of the conductor 4; therefore, the wire has excellent flexibility in the lengthwise direction thereof.

Embodiment 4

In this embodiment, magnetic powder of Fe—B powder was used wherein an aspect ratio of the particles is 3, and a particle size is 3 to 50 μm. As same as embodiment 3, the magnetic powder and ethylene-octene copolymer were mixed, and then the mixture was introduced into the cavity 3 through the introduction port in the die 2 heated to about 150° C. of the apparatus shown in FIG. 2. Thus, the wire 14 having the magnetic insulation coat 26 on the conductor 4 is continuously produced. The ferromagnetic material is disposed at the exit side of the die 2 to constitute a magnetic circuit.

Figure 6:
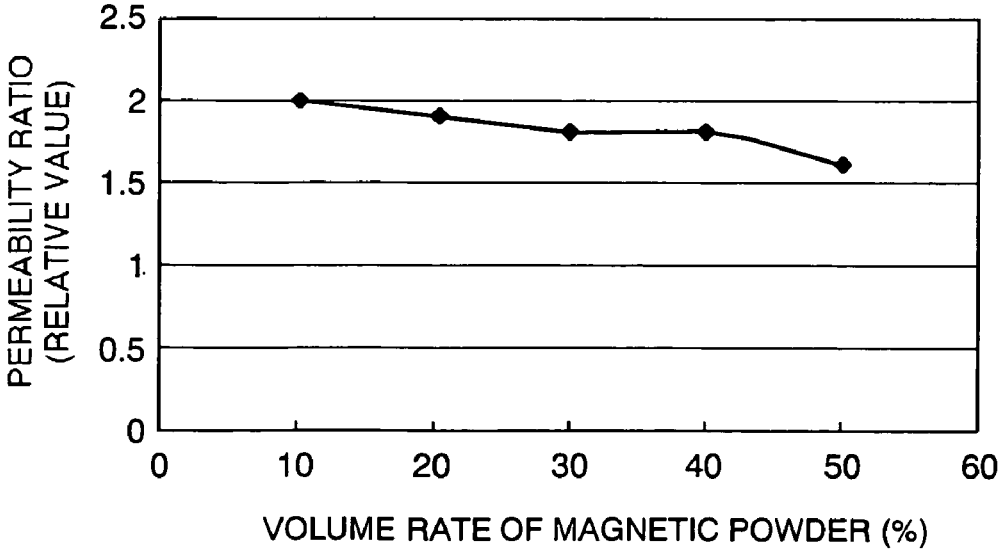
FIG. 6 is a graph showing relationship between permeability ratio (relative value) of the electromagnetic insulation coat measured in a magnetic field of 1000 Oe and a volume rate of the magnetic powder in the electromagnetic insulation coat.

FIG. 6 is a graph showing relationship between the permeability ratio and the volume rate of the magnetic powder in the composite material. As shown in FIG. 6, the permeability ratio in case of a magnetic field of 1000 Oe is simply decreasing with an increase in the volume rate from 10% to 50%. The permeability at the volume rate of 50% is as large as 1.5. If the volume rate is 10%, the permeability ratio is 2.0. If the anisotropic magnetic field is not applied to the coat, there is no difference in permeability between the circumferential direction and the axial direction of the conductor. However, since the dependency of anisotropy on direction appears under magnetic field, the permeability ratio ranges from 1.5 to 2.0.

The permeability ratio decreases with the increase in the volume of the magnetic powder. This is because the strength of the magnetic field is weak, and therefore, the rotation of the particles of the magnetic powder was difficult.

In this embodiment, the lengthwise direction of the particles of the magnetic powder is oriented along the circumferential direction, and the resulting wire has excellent flexibility in the axial direction of the wire.

Embodiment 5

Figure 7:
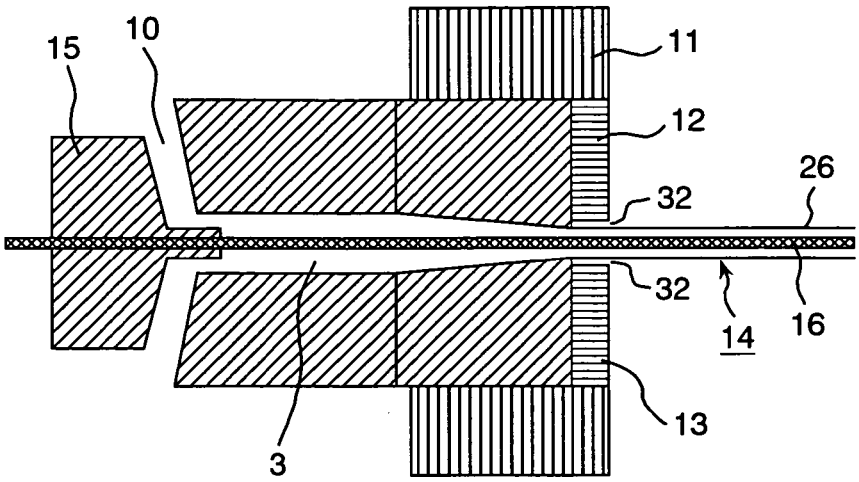
FIG. 7 is a cross sectional view of the apparatus according to another embodiment of the present invention.
Figure 8:
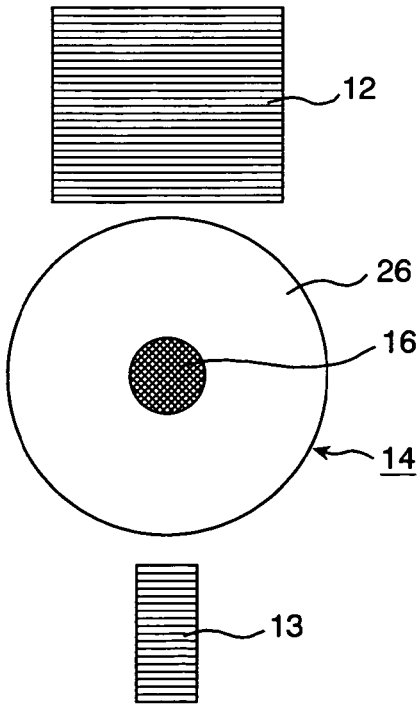
FIG. 8 is a front plan view of an exit portion of the die of the apparatus shown in FIG. 7.

FIG. 7 shows a cross sectional view of an apparatus for manufacturing a wire according to another embodiment, and FIG. 8 is a front plan view at the exit side of the apparatus shown in FIG. 7. In this embodiment, a pair of yokes made of a ferromagnetic material is disposed at the upper and lower positions to sandwich the wire 16 to concentrate magnetic lines of force around the exit of the die. The upper yoke 12 has a size larger than the diameter of the conductor 16, but the lower yoke 13 has a size smaller than the conductor 16 as shown in FIG. 8.

There are gaps 32 between the upper yoke 12 or lower yoke 13 and the wire so that the yokes 12, 13 do not touch the wire 16. The composite material introduced into the cavity 3 of the die 2 is pressurized by a pressure device 15 to extrude it. The diameter of the wire is determined by the diameter of the die at the exit side, while forming the coat 26 on the conductor 16. The permanent magnet 11 is preferably made of $Sm_2Co_{17}$ sintered alloys because the alloy has a high Curie point.

As shown in FIG. 8, the size of the lower yoke 13 in the circumferential direction is smaller than that of the upper yoke, thereby to concentrate magnetic lines of force around the conductor. Further, the upper yoke 12 has a size larger than that of the lower yoke 13, but smaller than the diameter of the conductor. As a result, the magnetic strength around the conductor becomes stronger.

The magnetic powder made of Fe—B powder had an aspect ratio of 3, and a particle size of 3 to 50 μm was used. The powder was mixed with chlorinated polyethylene; then the mixture was introduced into the cavity of the die heated to about 150° C. through the introduction port 10. The composite material and the conductor 16 were extruded from the exit of the die to form a wire having a coat 26 on the conductor 16, while applying the magnetic field to the wire. The strength of the magnetic field is at most 10 kOe.

Figure 9:
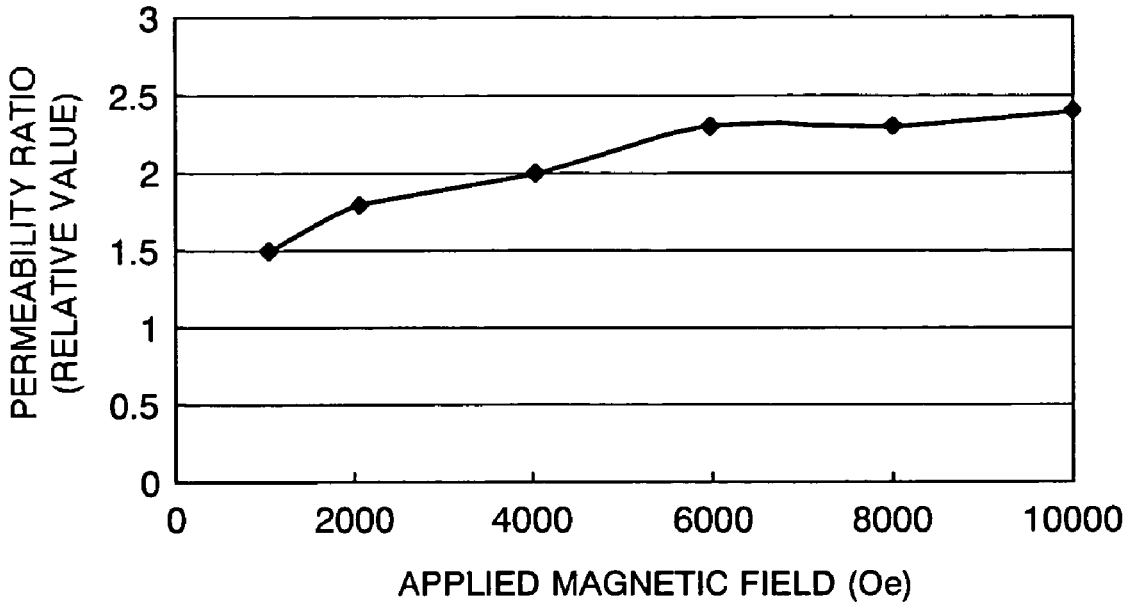
FIG. 9 is a graph showing relationship between permeability ratio (relative value) and strength (Oe) of a magnetic field.

FIG. 9 is a graph showing relationship between permeability ratio and applied magnetic field strength. The permeability ratio is the same as in FIG. 5. As shown in FIG. 9, the wire produced by the apparatus having magnetic circuit that is formed by the die and the yokes shown in FIGS. 7 and 8 shows permeability ratio increased with the strength of the magnetic field when the outer diameter of the wire is 3 mm and the diameter of the conductor is 2 mm. The maximum permeability ratio was 2.4. Such the high permeability ratio is obtained by application of the high strength of the magnetic field.

When the apparatus shown in FIGS. 7 and 8 is used, the particles of the magnetic powder are oriented in the magnetic lines of force generated by the permanent magnets or electromagnets 11, 13. When the aspect ratio of the particles is 2 or more, the lengthwise axis of the particles is sufficiently oriented along the magnetic lines of force. This is because the static magnetic field energy becomes low.

The orientation direction of the particles was confirmed by an X-ray diffraction method, observation of phase structure using a SEM (a scanning electron microscope) or by a magnetic characteristic evaluation. The magnetic characteristic evaluation method includes a measurement of torque curve, permeability, and magnetization curve. Further, in this embodiment, the wire excellent in flexibility in the lengthwise direction or axial direction of the conductor was obtained.

The embodiments of the present invention provide magnetic insulation wires that can reduce high frequency noise induced by electromagnetic wave, and a method of manufacturing the wires and an apparatus for manufacturing the same.

What is claimed is:

1. An electromagnetic insulation wire, which comprises a conductor and a coat firmly formed on the conductor, the coat being a composite material comprising a resin matrix and a magnetic powder dispersed in the resin matrix, wherein the coat has an anisotropic magnetic permeability, which is larger in the circumferential direction of the wire than in the lengthwise direction of the wire, and wherein the particles are oriented in such a manner that a lengthwise direction of the particles is aligned in the circumferential direction of the conductor.

2. The electromagnetic insulation wire according to claim 1, wherein at least part of the particles of the powder has an aspect ratio larger than 1.

3. The electromagnetic insulation wire according to claim 1, wherein the aspect ratio of the particles of the magnetic powder is 2 to 10.

4. The electromagnetic insulation wire according to claim 1, wherein the coat of the composite material has a substantially homogeneous distribution of the particles in the lengthwise direction of the wire.

5. The electromagnetic insulation wire according to claim 1, wherein the coat of the composite material is substantially free from magnetic irregularity in the circumferential direction and in the lengthwise direction of the wire.

6. An electromagnetic insulation wire, which comprises a conductor and a coat firmly formed on the conductor, the coat being a composite material comprising a resin matrix and a magnetic powder dispersed in the resin matrix, wherein an aspect ratio of at least part of particles of the magnetic powder is larger than 1, the lengthwise direction of the at least part of the particles are oriented in the circumferential direction of the wire, the coat has an anisotropic magnetic permeability, which is larger in the circumferential direction of the wire than in the lengthwise direction of the wire.

7. The electromagnetic insulation wire according to claim 6, wherein the aspect ratio of the particles of the magnetic powder is 2 to 10.

8. The electromagnetic insulation wire according to claim 6, wherein the particles are oriented in such a manner that a lengthwise direction of the particles is aligned in the circumferential direction of the conductor.

* * * * *